US005680677A

United States Patent [19]

Lovell

[11] Patent Number: 5,680,677

[45] Date of Patent: Oct. 28, 1997

[54] WATER SKI HANDLE

[76] Inventor: John William Lovell, 416 Clifford Dr., Delakb, Ill. 60115

[21] Appl. No.: 695,681

[22] Filed: Jul. 22, 1996

[51] Int. Cl.[6] ..... A47B 95/02; A63C 15/06

[52] U.S. Cl. ..... 16/111 R; 16/125; 441/69; 114/253

[58] Field of Search ..... 16/111 R, 110 R, 16/125, 127; 441/68, 69; 114/253; D21/236, 229, 230

[56] References Cited

U.S. PATENT DOCUMENTS

| | | | |
|---|---|---|---|
| D. 256,487 | 8/1980 | Pittman | D21/230 |
| 3,830,188 | 8/1974 | Humbert | 114/235 |
| 4,280,240 | 7/1981 | Neuscheler | 114/253 |
| 4,895,538 | 1/1990 | Marks | 441/69 |
| 5,503,580 | 4/1996 | McCarthy | 441/69 |

*Primary Examiner*—Chuck Y. Mah

[57] ABSTRACT

A water ski handle including a frame member. The frame member has a back bar and a pair of side bars integral the back bar. One of the side bars extends from one end of the back bar, while another of the side bars extends from another end of the back bar. Each side bar has an inwardly curved portion near a distal end. A handle bar is positioned through the distal ends of the left and right side bars of the frame. Lastly, a rope connector is tied to the handle bar. The rope connector is capable of coupling with a water ski tow line. The rope connector, when coupled with the tow line, allows the skier to be pulled through the water when holding the handle bar coupled to the frame.

8 Claims, 3 Drawing Sheets

FIG 3
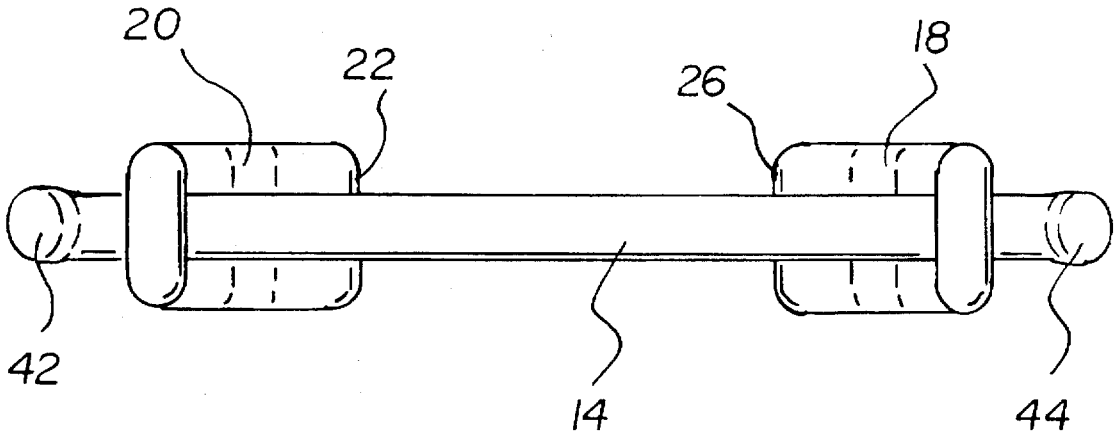
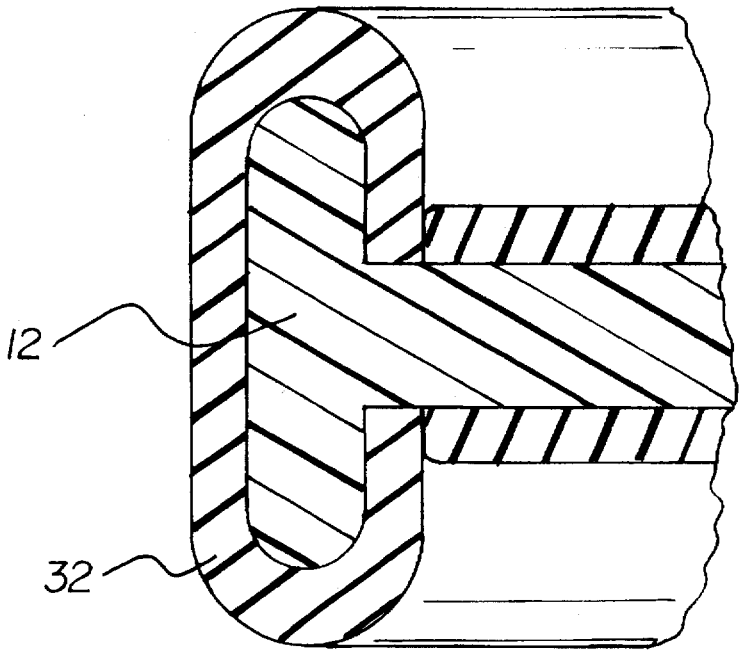
FIG 4

FIG 5
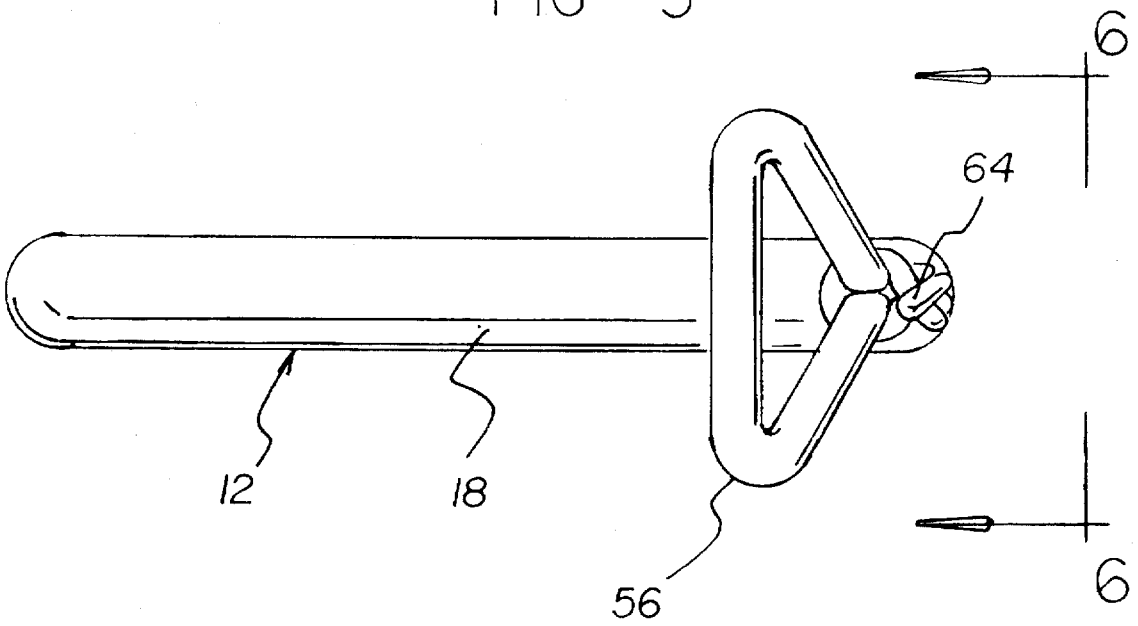
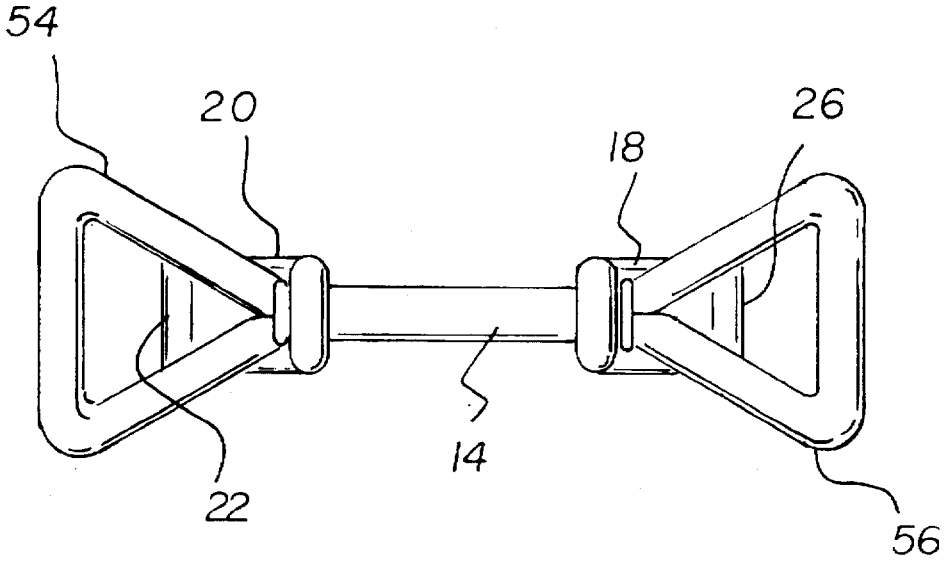
FIG 6

WATER SKI HANDLE

BACKGROUND OF THE INVENTION

1. Field of the Invention

The present invention relates to a water ski handle and more particularly pertains to providing a water ski handle with a bell-shaped frame that has grips for horizontal and vertical grasping by the skier when in tow.

2. Description of the Prior Art

The use of a water ski handle assembly is known in the prior art. More specifically, water ski handle assemblies heretofore devised and utilized for the purpose of XFXOLD are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,863,407 to Casad discloses a water ski handle assembly. U.S. Pat. No. 4,867,722 to Joseph discloses a convertible water ski handle. U.S. Pat. No. Des. 283,908 to Ziomek discloses a water ski handle. U.S. Pat. No. 4,371,352 to Holland discloses a water ski tow handle. U.S. Pat. No. 4,280,240 to Neuscheler discloses a handle for water ski towline with engagement and eisengagement mens for ware ski safety belt. Lastly, U.S. Pat. No. Des. 273,086 to Coleman discloses a unitary water ski rope handle and reel.

While these devices fulfill their respective, particular objectives and requirements, the aforementioned patents do not describe water ski handle that allows some of the tension and stress to the hands of a skier to be transferred to the forearms of the skier by way of the side bars of the frame.

In this respect, the Water ski handle according to the present invention substantially departs from the conventional concepts and designs of the prior art, and in doing so provides an apparatus primarily developed for the purpose of providing a water ski handle with a bell-shaped frame that has grips for horizontal and vertical grasping by the skier when in tow.

Therefore, it can be appreciated that there exists a continuing need for a new and improved Water ski handle which can be used for providing a water ski handle with a bell-shaped frame that has grips for horizontal and vertical grasping by the skier when in tow. In this regard, the present invention substantially fulfills this need.

SUMMARY OF THE INVENTION

In view of the foregoing disadvantages inherent in the known types of water ski handle assemblies now present in the prior art, the present invention provides an improved water ski handle. As such, the general purpose of the present invention, which will be described subsequently in greater detail, is to provide a new and improved water ski handle and method which has all the advantages of the prior art and none of the disadvantages.

To attain this, the present invention essentially comprises a frame member. The frame member has a back bar and a pair of side bars integral the back bar. The pair of side bars form a right side bar and a left side bar. One of the side bars extends from one end of the back bar, while another of the side bars extends from another end of the back bar. Each side bar projecting inwardly at about a sixty degree angle. The left side bar has an inwardly curved portion near a left distal end. The right side bar has an inwardly curved portion near a right distal end. The inwardly curved portions of each side bar allows spacing between the right and left side bars. Also, a handle bar is positioned through the distal ends of the left and right side bars of the frame. The handle bar has a longitudinal bar with a pair of cylindrical grips. The pair of cylindrical grips form a left grip and a right grip. The left grip is spaced from the left side bar of the frame. The right grip is spaced from the right side bar of the frame. Each grip is grasped by a hand of a skier in a horizontal orientation. Lastly, a rope connector is tied to the handle bar. The rope connector has a first end tied adjacent the distal end of the left side bar of the frame. The rope connector has a second end tied adjacent the distal end of the right side bar of the frame. The rope connector is capable of coupling with a water ski tow line. The rope connector, when coupled with the tow line, is capable of allowing the skier to be pulled through the water when holding the handle bar coupled to the frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Water ski handle which has all of the advantages of the prior art water ski handle assemblies and none of the disadvantages.

It is another object of the present invention to provide a new and improved water ski handle which may be easily and efficiently manufactured and marketed.

It is further object of the present invention to provide a new and improved water ski handle which is of durable and reliable constructions.

An even further object of the present invention is to provide a new and improved water ski handle which is susceptible of a low cost of manufacture with regard to both materials and labor, and which accordingly is then susceptible of low prices of sale to the consuming public, thereby making such water ski handle economically available to the buying public.

Still yet another object of the present invention is to provide a new and improved water ski handle which provides in the apparatuses and methods of the prior art some of the advantages thereof, while simultaneously overcoming some of the disadvantages normally associated therewith.

Even still another object of the present invention is to provide a water ski handle for providing a water ski handle with a bell-shaped frame that has grips for horizontal and vertical grasping by the skier when in tow.

Lastly, it is an object of the present invention to provide a new and improved water ski handle including a frame member. The frame member has a back bar and a pair of side bars integral the back bar. One of the side bars extends from one end of the back bar, while another of the side bars extends from another end of the back bar. Each side bar has an inwardly curved portion near a distal end. A handle bar is positioned through the distal ends of the left and right side bars of the frame. Lastly, a rope connector is tied to the handle bar. The rope connector is capable of coupling with a water ski tow line. The rope connector, when coupled with the tow line, allows the skier to be pulled through the water when holding the handle bar coupled to the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is rear view of the present invention taken along line 3—3 of FIG. 1.

FIG. 4 is a cross-sectional cut away view taken along line 4—4 of FIG. 1.

FIG. 5 is a side elevational view of the another embodiment of the water ski handle constructed in accordance with the principles of the present invention.

FIG. 6 is rear view of the other embodiment taken along line 6—6 of FIG. 5.

The same reference numerals refer to the same parts through the various Figures.

DESCRIPTION OF THE PREFERRED EMBODIMENT

Figure 1:
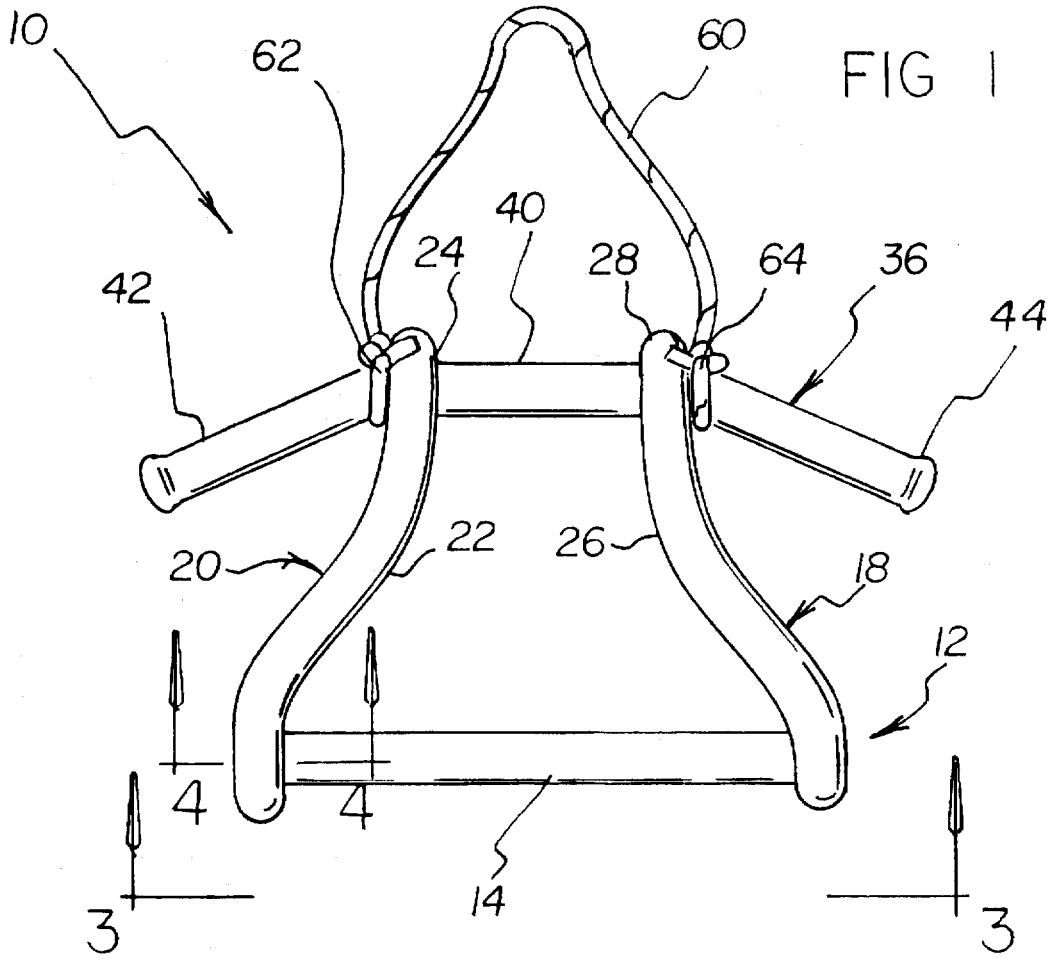
FIG. 1 is a perspective view of the preferred embodiment of the water ski handle constructed in accordance with the principles of the present invention.

With reference now to the drawings, and in particular to FIG. 1 thereof, the preferred embodiment of the new and improved water ski handle embodying the principles and concepts of the present invention and generally designated by the reference numeral 10 will be described.

The present invention, the water ski handle 10 is comprised of a plurality of components. Such components in their broadest context include a frame, a handlebar and a rope. Such components are individually configured and correlated with respect to each other so as to attain the desired objective.

Specifically, the present invention includes a frame member 12, as shown in FIG. 1. The frame member is a ridged material that may be metal or plastic. The frame member has a back bar 14 and a pair of side bars integral the back bar. The back bar and side bars give the frame member the shape of the bottom portion of a bell. The pair of side bars form a right side bar 18 and a left side bar 20. One of the pair of side bars extend from one end of the back bar, while another of the pair of side bars extend from another end of the back bar.

Also, each side bar projects inwardly at about a sixty degree angle. The left side bar has an inwardly curved portion 22 near a left distal end 24. The right side bar has an inwardly curved portion 26 near a right distal end 28. FIG. 3 shows, the inwardly curved portions of each side bar allowing space between the right and left side bars. The frame is completely covered with a form-fitting layer of foam padding 32. The cross-sectional view shown in FIG. 4 shows the padding positioned on the frame.

Additionally, a handle bar 36 is positioned through the distal ends of the left and right side bars of the frame 12. The handle bar is formed of a rigid material. The handle bar is covered in the same type of foam padding 32 covering the frame. The handle bar has a longitudinal bar 40 with a pair of cylindrical grips.

Figure 2:
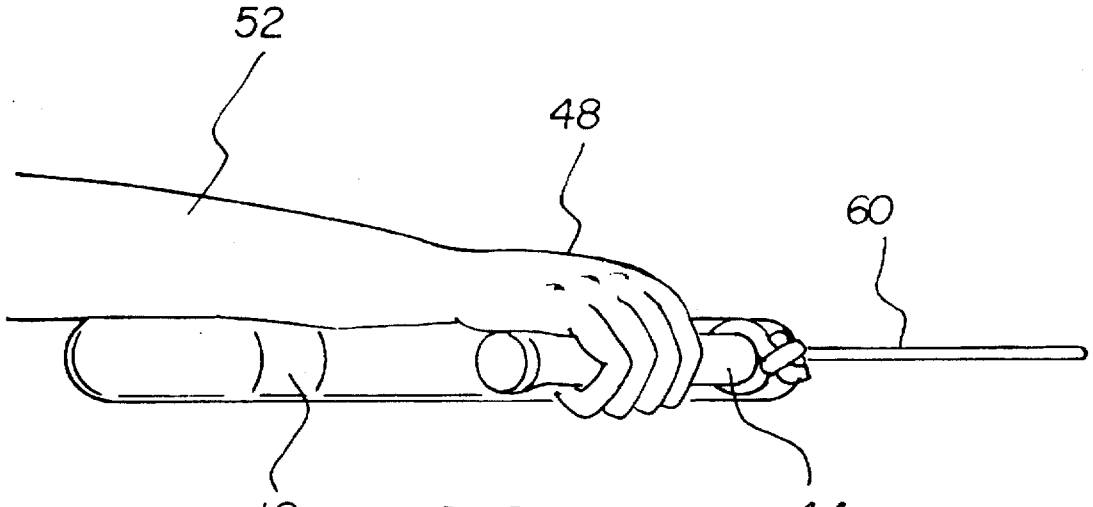
FIG. 2 is a side elevational view of the present invention in an operable orientation.

The pair of cylindrical grips forming a left grip 42 and a right grip 44. The left grip is spaced from the left side bar 20 of the frame. The right grip is spaced from the right side bar 18 of the frame. Each grip is angled slightly in the direction of the back bar of the frame. Each grip may be grasped by a hand 48 of a skier in a horizontal orientation, as depicted in FIG. 2. When the hands of the skier are grasping the grips the forearms 52 are braced against the side bars of the frame.

As best illustrated in FIG. 5, the longitudinal bar 40 of the handle bar may have a pair of triangular grips. The triangular grips are made of a rigid material that may be plastic or metal. The triangular grips form a left grip 54 and a right grip 56, as seen in FIG. 6. The left grip is spaced from the right side bar of the frame. The right grip is spaced from the left side bar of the frame. Each grip capable of being grasped by a hand of a skier in a vertical orientation. When the hands of the skier are grasping the grips the forearms 52 are braced against the side bars of the frame.

Lastly, a rope connector 60 is tied to the handle bar 36. The rope connector has a first end 62 tied adjacent the distal end 24 of the left side bar of the frame. The rope connector has a second end 64 tied adjacent the distal end 28 of the right side bar of the frame. The rope connector is capable of coupling with a water ski tow line. The rope connector, when coupled with the tow line, allows the skier to be pulled through the water when holding the handle bar coupled to the frame.

The present invention is a ergonomiclly structured water ski handle. The water ski handle has a frame with side bars to support the forearms of the water skier. The present invention has a handle bar with grips. The grips of the handle bar may be of the type to allow horizontal grasping or vertical grasping by the hands. The present allows all the work of hanging on to the tow rope, formerly done by the fingers and hands, to be shared by the forearms and wirsts of the skier. The present invention allows skiers to enjoy skiing for longer periods of time. The water ski handle of the present invention floats for easy retrieval if droped while skiing. Finally the present invention may be used by skiers of all skill levels.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved water ski handle for reducing hand and finger stress of the skier while in tow a comprising in combination:

a frame member having a back bar and a pair of side bars integral thereto, the pair of side bars forming a right side bar and a left side bar, one of the side bars extends from one end of the back bar while another of the side bars extends from another end of the back bar, each side bar projecting inwardly at about a sixty degree angle, the left side bar having an inwardly curved portion near a left distal end, the right side bar having an inwardly curved portion near a right distal end, the inwardly curved portions of each side bar allowing space between the right and left side bars;

a handle bar being positionable through the distal ends of the left and right side bars of the frame, the handle bar having a longitudinal bar with a pair of cylindrical grips, the pair of cylindrical grips forming a left grip and a right grip, the left grip being spaced from the left side bar of the frame, the right grip being spaced from the right side bar of the frame, each grip capable of being grasped by a hand of a skier in a horizontal orientation; and a rope connector being tied to the handle bar, the rope connector having a first end tied adjacent the distal end of the left side bar of the frame, the rope connector having a second end tied adjacent the distal end of the right side bar of the frame, the rope connector being capable of coupling with a water ski tow line, the rope connector when coupled with the tow line capable of allowing the skier to be pulled through the water when holding the handle bar coupled to the frame.

2. A new and improved water ski handle comprising:

a frame member having a back bar and a pair of side bars integral thereto, one of the side bars extends from one end of the back bar while another of the side bars extends from another end of the back bar, each side bar having an inwardly curved portion near a distal end thereof;

a handle bar being positionable through the distal ends of the left and right side bars of the frame; and a rope connector being tied to the handle bar, the rope connector being capable of coupling with a water ski tow line, the rope connector when coupled with the tow line capable of allowing the skier to be pulled through the water when holding the handle bar coupled to the frame.

3. The water ski handle as set forth in claim 2, wherein the pair of side bars forming a right side bar and a left side bar.

4. The water ski handle as set forth in claim 3, wherein each side bar projecting inwardly at about a sixty degree angle, the left side bar having an inwardly curved portion near a left distal end, the right side bar having an inwardly curved portion near a right distal end, and the inwardly curved portions of each side bar allowing space between the right and left side bars.

5. The water ski handle as set forth in claim 2, wherein the handle bar having a longitudinal bar with a pair of cylindrical grips, one of the cylindrical grips being spaced from the right side bar of the frame while another cylindrical grip being spaced from the left side bar of the frame, and each grip capable of being grasped by a hand of a skier.

6. The water ski handle as set forth in claim 2, wherein the handle bar having a longitudinal bar with a pair of triangular grips, one of the triangular grips being spaced from the right side bar of the frame while another triangular grip being spaced from the left side bar of the frame, and each grip capable of being grasped by a hand of a skier.

7. The water ski handle as set forth in claim 2, wherein the rope connector having a first end tied adjacent the distal end of the left side bar of the frame, and the rope connector having a second end tied adjacent the distal end of the right side bar of the frame.

8. A new and improved water ski handle for reducing hand and finger stress of the skier while in tow comprising in combination:

a frame member having a back bar and a pair of side bars integral thereto, the pair of side bars forming a right side bar and a left side bar, one of the side bars extends from one end of the back bar while another of the side bars extends from another end of the back bar, each side bar projecting inwardly at about a sixty degree angle, the left side bar having an inwardly curved portion near a left distal end, the right side bar having an inwardly curved portion near a right distal end, the inwardly curved portions of each side bar allowing space between the right and left side bars;

a handle bar being positionable through the distal ends of the left and right side bars of the frame, the handle bar having a longitudinal bar with a pair of triangular grips, the triangular grips forming a left grip and a right grip, the left grip being spaced from the right side bar of the frame, the right grip being spaced from the left side bar of the frame, and each grip capable of being grasped by a hand of a skier in a vertical orientation; and a rope connector being tied to the handle bar, the rope connector having a first end tied adjacent the distal end of the left side bar of the frame, the rope connector having a second end tied adjacent the distal end of the right side bar of the frame, the rope connector being capable of coupling with a water ski tow line, the rope connector when coupled with the tow line capable of allowing the skier to be pulled through the water when holding the handle bar coupled to the frame.

* * * * *